US007000815B1

(12) United States Patent
Tipton et al.

(10) Patent No.: US 7,000,815 B1
(45) Date of Patent: Feb. 21, 2006

(54) UNIVERSAL PILL SPLITTER

(76) Inventors: Norman Ernest Tipton, 10233 El Capitan Real Rd., El Cajon, CA (US) 92021; Shirley Jean Tipton, 10233 El Capitan Real Rd., El Cajon, CA (US) 92021

( * ) Notice: Subject to any disclaimer, the term of this patent is extended or adjusted under 35 U.S.C. 154(b) by 0 days.

(21) Appl. No.: 10/906,311

(22) Filed: Feb. 14, 2005

(51) Int. Cl.
*B26F 3/00* (2006.01)

(52) U.S. Cl. ..... 225/103; 225/104

(58) Field of Classification Search ..... 225/93, 225/103, 104; 30/124, 120.1; D24/220; 241/DIG. 27
See application file for complete search history.

(56) References Cited

U.S. PATENT DOCUMENTS

| | | | | |
|---|---|---|---|---|
| 3,517,871 | A | 6/1970 | Gaffney | |
| 3,815,802 | A | 6/1974 | Stevens | |
| 4,173,826 | A | 11/1979 | Leopoldi et al. | |
| 4,179,806 | A | 12/1979 | Lieptz | |
| 4,199,863 | A | 4/1980 | Deckert | |
| 4,473,192 | A | 9/1984 | Urban et al. | |
| 4,824,000 | A | 4/1989 | Baxter et al. | |
| 4,887,755 | A * | 12/1989 | Gibilisco | 225/103 |
| D310,731 | S | 9/1990 | Lieptz | |
| 5,038,475 | A | 8/1991 | Wolff | |
| 5,118,021 | A | 6/1992 | Fiocchi | |
| 5,944,243 | A | 8/1999 | Weinstein | |
| 6,474,525 | B1 | 11/2002 | Reitano | |
| D468,023 | S * | 12/2002 | Buckley et al. | D24/220 |
| 6,527,155 | B1 * | 3/2003 | Buckley et al. | 225/1 |
| 6,557,945 | B1 * | 5/2003 | Eric | 30/124 |
| 6,601,746 | B1 * | 8/2003 | Buckley et al. | 225/103 |
| 6,644,528 | B1 | 11/2003 | Reitano | |
| 2003/0019900 | A1 * | 1/2003 | Dienst | 225/104 |

FOREIGN PATENT DOCUMENTS

| | | | |
|---|---|---|---|
| BE | 1009420 | * | 3/1997 |

* cited by examiner

*Primary Examiner*—Stephen Choi

(57) ABSTRACT

A pill splitter including a support body with an inclined plane having a triangular shaped recess with sidewalls incorporating a plurality of alternating linear sectors and inwardly curved sectors for centering a wide variety of shapes and sizes of pills to be split by a knife mounted on a cover which is pivotally mounted on the support body.

3 Claims, 5 Drawing Sheets

UNIVERSAL PILL SPLITTER

CROSS REFERENCE TO RELATED SPECIFCATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to devices for splitting solid pills, tablets and the like and, in particular, relates to devices with the capability to split solid pills of virtually any shape, can be manipulated by the aged and/or the infirm or the blind, and is inexpensive to manufacture.

It is frequently required that prescription pills, vitamin pills and the like be ingested at a dosage which is less than that of a full pill. Additionally, it is often the case that pills can be more economically purchased if they are purchased at a higher dosage and then split to the desired dosage. While the need to split pills is widespread, it is also the case that the persons who are aged and/or infirm are the most likely to require some form of medication and therefore are the ones who are most likely to require a pill splitter. Unfortunately, persons who are aged and/or infirm are the ones who are also more likely to have difficulty in engaging in the manual dexterity, or who have the sight, required to accurately manipulate pill splitters available prior to the subject invention.

The primary failing of the prior art is that of providing an inexpensive pill splitting device that can be used to positively position pills of various shapes and sizes so that they can be accurately split. The pills that are most easily split are those that are round. A number of pill splitting devices employ a simple V shaped pill bed to center round pills for splitting. However, when an attempt is made to utilize a simple V shaped configuration to center pills of other than round configurations, the trembling hands of the aged and/or the infirm, coupled with the possibility of poor or no eyesight, can make the accurate centering of a pill extremely difficult.

A number of pill splitting devices have been proposed which address the splitting of pills of various shapes. Examples are: U.S. Pat. No. 6,644,528 to Reitano describes a pill splitter that utilizes a family of beds, which substantially conform to the shapes of pills to be split. This approach requires a relatively expensive device to manufacture and the installation of the various pill splitting beds poses a challenge to the aged and/or the infirm or the blind. Additionally, a number of pill splitting beds must be kept track of so as not to be lost and new beds must be added as new pill shapes and sizes are developed; U.S. Pat. No. 5,118,021 to Flocchi describes a pill splitting device which incorporates a pill bed enclosed by a diamond shaped wall. The diamond shape accommodates round pills, but the only place that an elongated pill can be accurately centered is at the midpoint of the diamond. Even then, the elongated pill must be of the same longitudinal dimension as the dimension of the midpoint of the diamond. Elongated pills of a lesser dimension cannot be positively centered by someone whose hands tremble or who has poor or no eyesight. Pills of other than elongated or round configurations are not addressed in Flocchi's patent; U.S. Pat. No. 5,038,475 to Wolff describes a pill splitting device that claims to accommodate both round and elongated pills. However, there are no positive means for securing a pill in a centered position and the pill can readily slip to an unfavorable position while the cover is being closed. This would be especially true if a person with trembling hands and/or poor or no sight was using the device. Additionally, the centering device described in Wolff's patent is fixed in dimension and does not lend itself to various pill lengths.

DETAILED DESCRIPTION OF THE INVENTION

Preferred Embodiment

Figure 1:
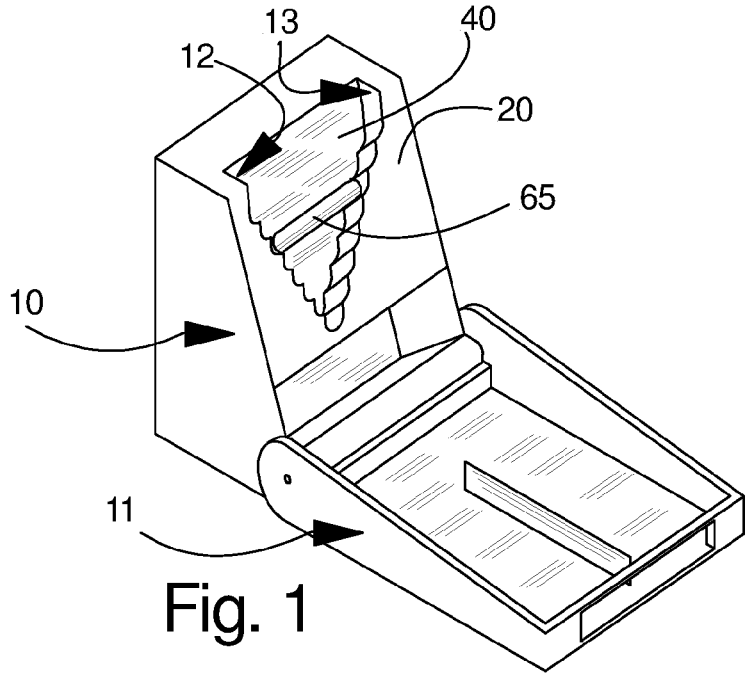
FIG. 1 Perspective view showing general arrangement of the subject invention with cover in open position.
Figure 5:
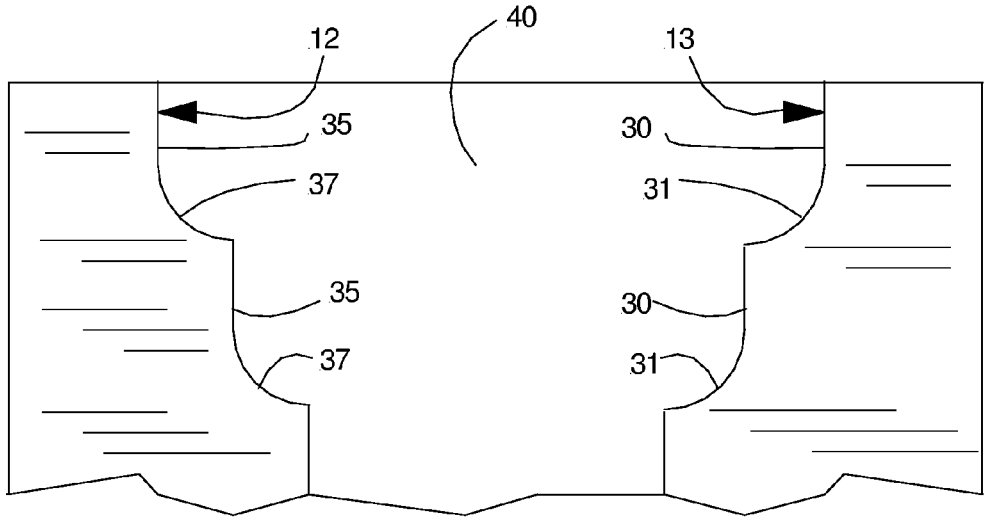
FIG. 5 Partial view of triangular recess showing details of pill centering sectors.
Figure 6A:
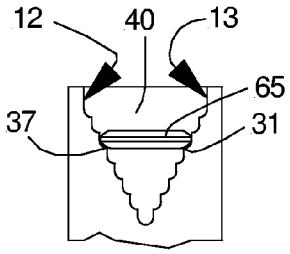
FIG. 6A View of triangular recess with an elongated pill in place.
Figure 6B:
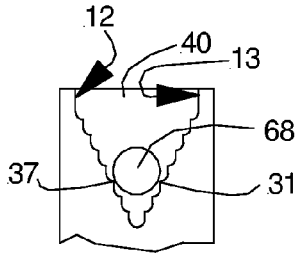
FIG. 6B View of triangular recess with a round pill in place.
Figure 6C:
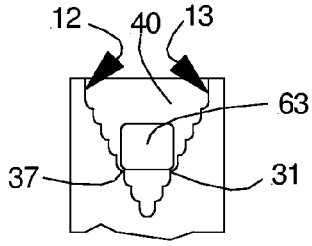
FIG. 6C View of triangular recess with a square pill in place.
Figure 6D:
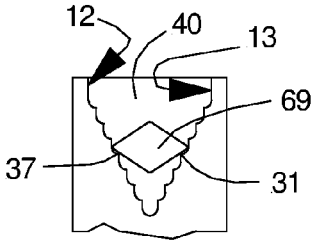
FIG. 6D View of triangular recess with a diamond shaped pill in place.
Figure 6E:
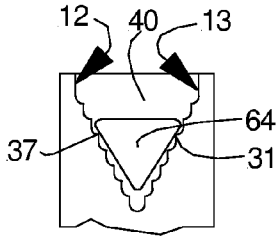
FIG. 6E View of triangular recess with a triangular shaped pill in place.

The preferred embodiment of a pill splitter made in accordance with the subject invention is generally illustrated in FIG. 1. The pill splitter includes a support body 10 with one face of the support body being an inclined plane 20. At the top of the inclined plane 20, there is an essentially triangular recess 40 with a depth sufficient to accommodate the thickness of the pills to be split. As illustrated in FIG. 1, the base of the triangular recess 40 is aligned with the top edge of the inclined plane 20 and has convergent sidewalls 12 and 13. In FIG. 5, the convergent sidewalls 12 and 13 are further detailed to show the pill centering properties of the subject invention. Left-hand sidewall 12 is composed of a series of linear sectors 35 and curved sectors 37. The linear sectors are parallel to a centerline between the left-hand 12 and the right-hand 13 sidewalls. The curved sectors 37 are curved inwardly toward the centerline between the left-hand 12 and right-hand 13 sidewalls. In a similar fashion, the right-hand sidewall 13 is composed of linear sectors 30 and curved sectors 31. The linear sectors 30 are parallel to a centerline between the left-hand 12 and right-hand 13 sidewalls. The inwardly curved sectors 31 are curved toward the centerline between the left-hand 12 and right-hand 13 sidewalls. As further illustrated in FIG. 5, the left-hand linear sectors 35 are cooperative with the right-hand linear sectors 30 to form a parallel path for pills of a smaller dimension then the distance between the linear sectors to pass through. The left-hand inwardly curved sectors 37 are cooperative with the inwardly curved sectors 31 of the right-hand sidewall to form a stop for pills having a larger dimension then the distance between the inwardly curved sectors thereby providing a series of diminishing distances between the pill stops as the left-hand and right-hand sidewalls of triangular recess 40 converge toward closure. FIG. 6A illustrates the centering of an elongated pill 65 between Left-hand sidewall 12 and right-hand sidewall 13. FIG. 6B shows the centering of a round pill 68. FIG. 6C shows the centering of a square pill 63. FIG. 6D shows the centering of a diamond shaped pill 69, and FIG. 6E shows the centering of a triangular shaped pill 64. Detailed descriptions of how each of the various shaped pills is centered follows in the operation section of this specification.

As illustrated in FIG. 1, cover 11 is pivotally mounted to the support body 10 for pivotal movement to and from the triangular recess 40 as the cover is opened and closed. The cover 11 and the triangular recess 40 have planer faces confronting when the cover 11 is closed. The cover 11 incorporates a knife-edge means fixedly mounted at its centerline and disposed to split a pill and essentially engage the centerline of the triangular recess 40 when the cover is closed.

Figure 2:
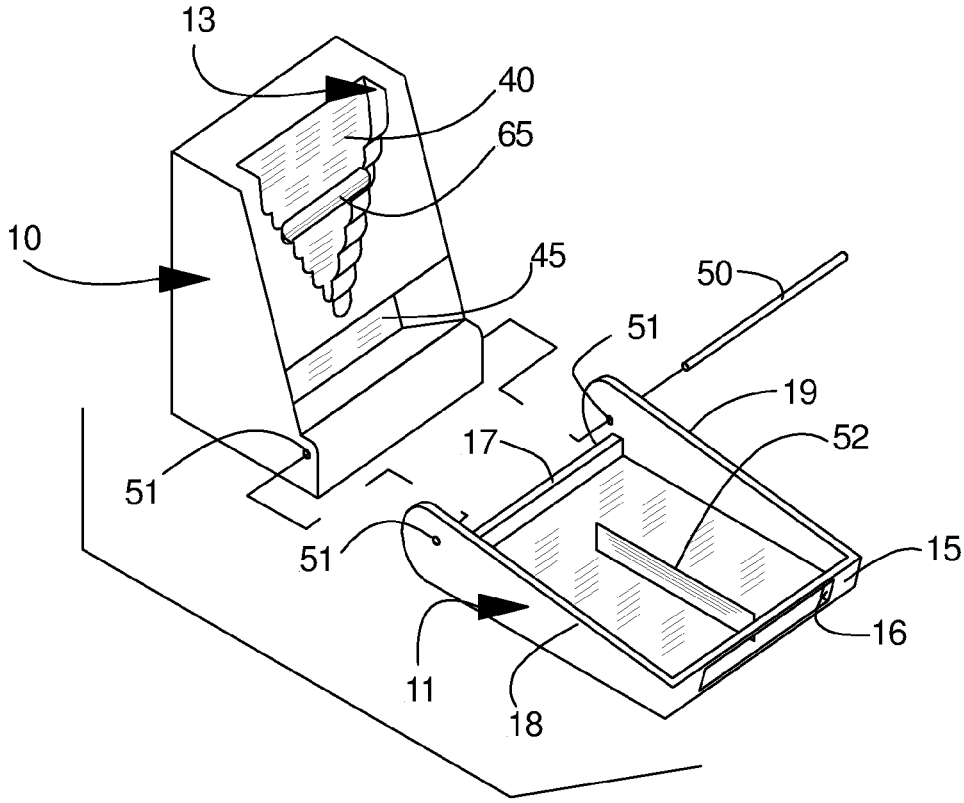
FIG. 2 Exploded perspective view of FIG. 1.

As illustrated in FIG. 2, the cover 11 incorporates a left-hand side 18 and a right-hand side 19, an end plate 15 and a pill retention plate 17 to form a container on the interior surface of cover 11. Roll pin holes 51 are drilled into the left-hand cover side 18 and the right-hand cover side 19 to accommodate installation of a roll pin 50. A corresponding roll pin hole 51 is drilled into the support body 10 to complete the hinge pivot capability. The end plate 15 incorporates a recess 16, which is disposed in such a manner as to align with and provide direct access to the triangular recess 40 when the cover 11 is closed.

Figure 3:
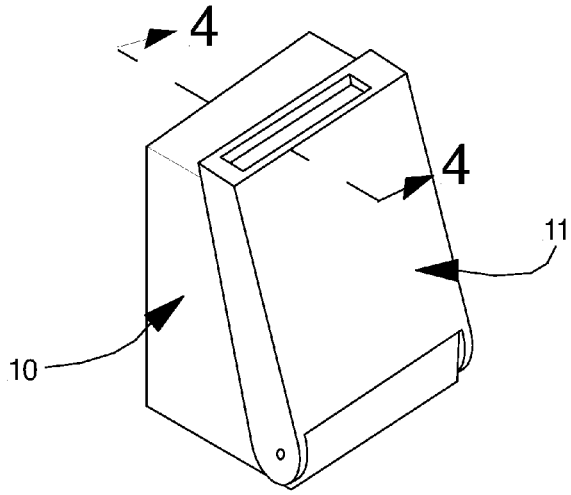
FIG. 3 Perspective view of subject invention with cover in a partially closed position.
Figure 4:
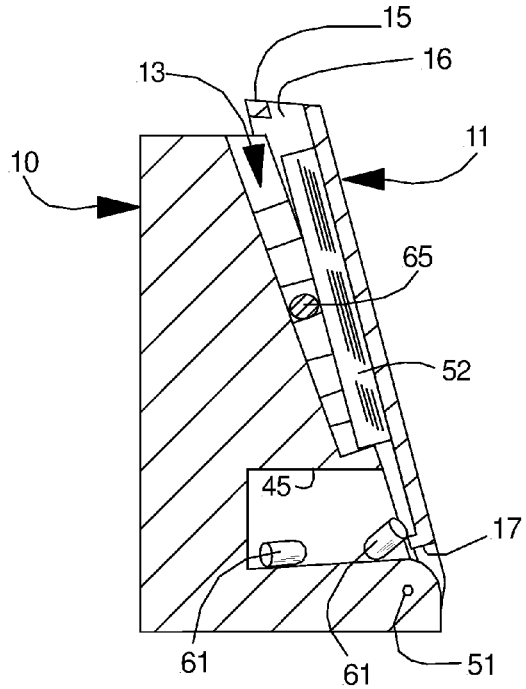
FIG. 4 Section view taken at section 4, 4 of FIG. 3.

FIG. 3 illustrates the subject invention with the cover 11 in a partially closed position. Section 4, 4 is taken through the support body 10 and the cover 11 just to the side of a vertical centerline of support body 10 and cover 11. FIG. 4 shows the section view 4, 4 of FIG. 3. As illustrated in FIG. 4, the cover 11 is in a partially closed position with knife-edge means 52 just making contact with an elongated pill 65. Pill repository recess 45 in support body 10 provides a means of storing split pills 61. The pill retention plate 17 is shown rotated into the pill repository recess 45. When cover 11 is fully rotated to the closed position, any split pills that are contained in the cover 11 are deposited into the pill repository recess 45.

FIG. 2 is an exploded perspective view of the subject invention to illustrate the components associated with its manufacture and assembly. The subject invention can be fabricated from a number of materials. For example, the device can be fabricated from plastic, glass, or metal with a preferred embodiment of plastic for the support body 10 and the cover 11. The preferred material for the knife-edge means 52 and the roll pin 50 is steel.

Alternate Embodiment

Figure 9:
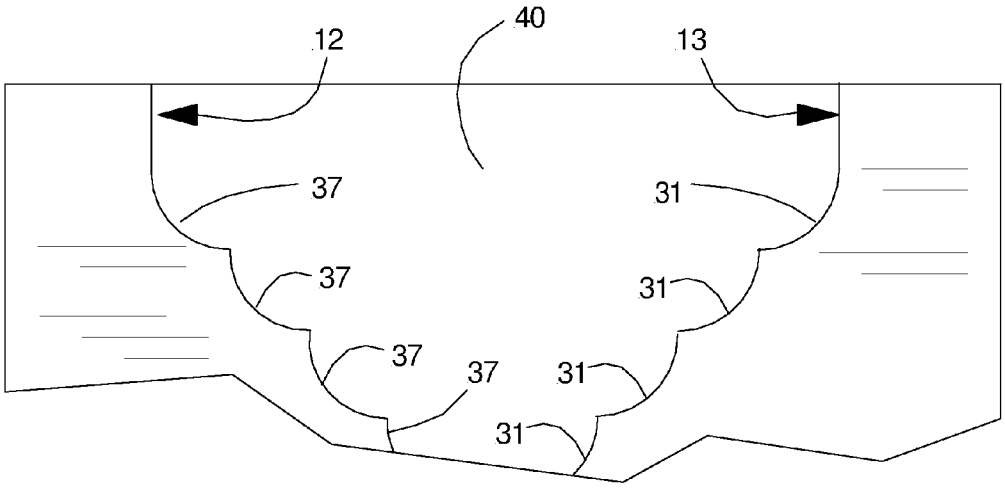
FIG. 9 Partial view of an alternative triangular recess showing a configuration of only inwardly curved sectors.

An alternate embodiment of the subject invention is described in FIG. 9. As indicated in FIG. 9, left-hand sidewall 12 and right-hand sidewall 13 are composed of left-hand inwardly curved sectors 37 and inwardly curved sectors 31, thus the linear sectors 36 and 30 are omitted. The alternate embodiment operation is precisely the same as for the preferred embodiment with the only difference being that the centering guidance provided by linear sectors 36 and 30 is omitted.

Operation:

The embodiment of the subject invention makes it particularly versatile in operation. The centering of typically shaped pills is illustrated in FIGS. 6A through 6D. To split elongated pills, the pill 65 is manually held horizontal and placed near the upper edge of triangular recess 40 with a side of the pill in contact with the planar surface of triangular recess 40. The pill is then slid downward while continuing to maintain the pill horizontal and in contact with the planar surface of triangular recess 40. Linear sectors 30 and 35 positively guide the pill as it travels downward. The pill will slide unimpeded through the linear sectors 30, 35 until the pill's longitudinal length exceeds the distance between the inwardly curved sectors 31, 37 at which point the inwardly curved sectors 31, 37 will stop further downward movement of the pill as illustrated in FIG. 6A. The inwardly curved sectors 31, 37 will not only arrest further downward movement of the pill, but the curvature of sectors 31, 37 will further aid in the precise centering of the pill even if the person performing the operation has trembling hands and/or poor or no eyesight.

Once the pill is centered, cover 11 as shown in FIG. 3, is rotated toward the closed position. As the knife-edge means 52 contacts the pill, a slight additional closing force on the cover 11 is all that is required to split the pill into very close to exactly equal halves.

When cover 11 is returned to the open position, the halves of the split pill can be manually removed from the triangular recess 40 or permitted to fall into the container formed by the cover 11, the cover sides 18 and 19 the end plate 15 and the pill retention plate 17. If it is desired to store pills in the pill repository recess 45, the cover is again closed. The split pills will then be rotated into the pill repository recess 45 for storage as indicated FIG. 4. The centering of other shaped pills is accomplished in a similar manner. When centering a round pill, the pill is placed at the top of the triangular recess 40. It is then slid downward while maintaining it in contact with the planar surface of triangular recess 40 until the inwardly curved sectors 31, 37 stop further downward movement as illustrated in FIG. 6B. When centering a square pill, the pill is placed in the top of triangular recess 40 with the top edge of the pill approximately parallel to the top edge of triangular recess 40. The pill is then slid downward while maintaining it in contact with the planar surface of triangular recess 40 until further downward movement is stopped by the inwardly curved sectors 31, 37 as indicated in FIG. 6C. A diamond shaped pill is centered by placing it at the top edge of triangular recess 40 with the maximum diameter of the diamond shaped pill parallel with the top edge of triangular recess 40. The pill is then slid downward while maintaining it in contact with the planar surface of triangular recess 40 until further downward movement is stopped by inwardly curved sectors 31, 37 as illustrated in FIG. 6D. As an alternative, a square pill can also be centered in the same manner as a diamond shaped pill by placing the square pill in triangular recess 40 with a diagonal of the square pill parallel with the top edge of triangular recess 40. A triangular shaped pill is centered by placing it at the top edge of triangular recess 40 with the base of the triangular shaped pill parallel to the top edge of triangular recess 40. The pill is then slid downward while maintaining it in contact with the planar surface of triangular recess 40 until further downward movement is stopped by inwardly curved sectors 31, 37 as illustrated in FIG. 6E. In all instances, once the pill is centered, the cover 11 is rotated to the closed position to cause the centered pill to be split by knife-edge means 52.

When the cover 11 is fully closed, the base support 10 is partially nested within the left-hand cover side 18, the right-hand cover side 19, and end plate 15. Friction between the support body 10 and the cover left-hand side 18, the cover right-hand side 19, and end plate 15 maintains the cover in a closed position for storage. The subject invention can then be confidently carried in a purse or pocket etc. with any stored split pills safely stored.

Figure 8:
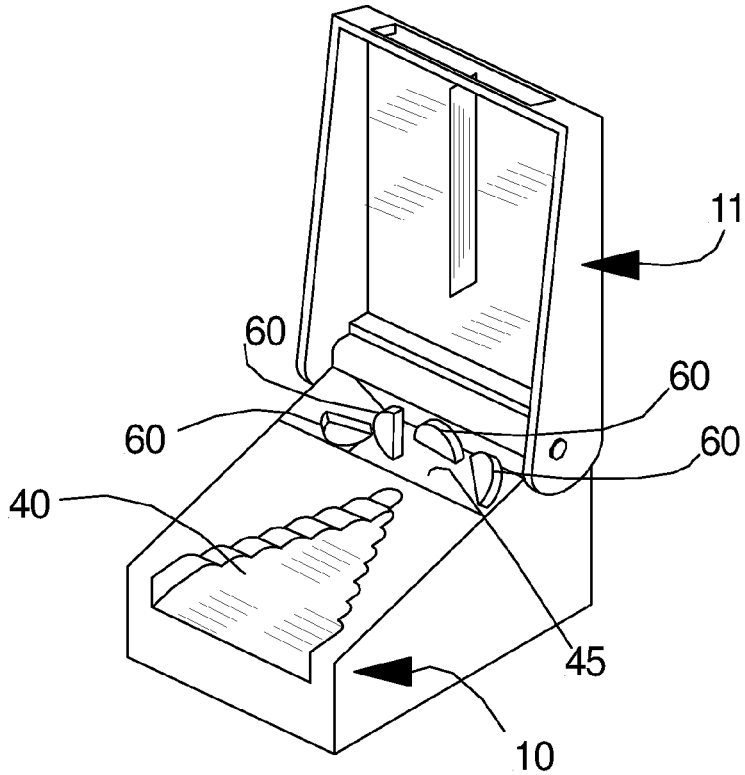
FIG. 8 Perspective view of FIG. 1 rotated 90 degrees.

When access to the stored pills is desired, the subject invention can be rotated 90 degrees and then opened as indicated in FIG. 8. This places the pill repository recess 45 with its contents of split pills in an attitude where the split pills will not spill from the pill repository recess 45 when the cover is opened. The split pills may then be individually removed as desired.

Figure 7:
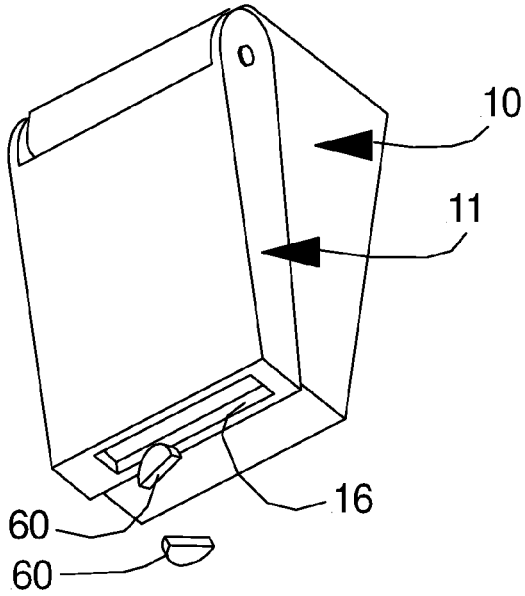
FIG. 7 Perspective view of subject invention in an inverted position with cover closed.

As an alternative to the storage of split pills in the pill repository recess 45, when the cover 11 of the subject invention has been closed to split a pill, the subject invention can then be inverted as indicated in FIG. 7, and the halves of the split pill 60 will be discharged through the recess 16 into the hand or a suitable receptacle. Thus the subject invention provides an inexpensive, accurate and readily utilized device that can be confidently used by the aged and/or infirm or the blind to split pills of virtually any size or shape.

It will be understood that certain features and sub-combinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in limiting sense.

What is claimed is:

1. A pill splitter comprising a support body with an inclined plane at one side, a triangular shaped recess residing at a top of said inclined plane with a base of said triangular recess being aligned with said top of said inclined plane and being open at said top of said inclined plane, said triangular recess having a left-hand side wall and right-hand sidewall, said left-hand sidewall and said right-hand sidewall thereby converging angularly to a closure at the bottom of said triangular recess, said left-hand sidewall and said right-hand sidewall incorporating a plurality of alternating linear sectors and inwardly curved sectors, said linear sectors being disposed parallel to a centerline between said left-hand sidewall and said right-hand sidewall, said curved sectors being disposed inwardly toward said centerline between said left-hand sidewall and said right-hand sidewall, said linear sectors on said left-hand sidewall being cooperative with said linear sectors on said right-hand sidewall to form a parallel path for pills of a smaller dimension than the distance between said linear sectors to pass through, said inwardly curved sectors on said left-hand sidewall being cooperative with said inwardly curved sectors on said right-hand sidewall to form a stop for pills having a larger dimension than the distance between said curved sectors thus providing a series of diminishing distances between said pill stops as said left-hand sidewall and said right-hand sidewall converge toward said closure whereby providing a positive means of centering pills of virtually any shape or size by even those that are aged, infirm or blind, and a cover pivotally mounted on said support body for pivotal movement to and from said triangular recess as said cover is opened and closed, said cover and said triangular recess having planar faces that are confronting when said cover is closed and a knife-edge means fixedly mounted on said cover, said knife-edge means being disposed to essentially engage said centerline between said left-hand sidewall and said right-hand sidewall when said cover is closed.

2. A device according to claim 1 wherein said cover incorporates cover sides that form a receptacle for capturing said pills as they are split and said cover is reopened, said cover sides to form a nested relationship with said support body when said cover is closed, said cover sides to engage frictionally with said cover sides to maintain cover in a closed position.

3. A device according to claim 1 wherein said inwardly curved sectors are substituted for said linear sectors thereby providing a series of paired said inwardly curved sectors in lieu of alternating pairs of said linear sectors and said inwardly curved sectors.

* * * * *